US005575095A

United States Patent [19]

Korn

[11] Patent Number: 5,575,095

[45] Date of Patent: Nov. 19, 1996

[54] CHAIR

[75] Inventor: Heinrich Korn, Maintal, Germany

[73] Assignees: Roeder GmbH; Hartmut S. Engel, both of Germany; a part interest

[21] Appl. No.: 173,612

[22] Filed: Dec. 27, 1993

Related U.S. Application Data

[63] Continuation-in-part of Ser. No. 437,058, Nov. 14, 1989, abandoned.

[30] Foreign Application Priority Data

Nov. 18, 1988 [DE] Germany ..... 38 38 999.1

[51] Int. Cl.[6] ..... A47C 1/032; A47C 3/00

[52] U.S. Cl. ..... 297/300.4; 297/322

[58] Field of Search ..... 297/300, 301, 297/281, 316, 326, 303, 322, 329, 300.4

[56] References Cited

U.S. PATENT DOCUMENTS

| | | | |
|---|---|---|---|
| 4,429,917 | 2/1984 | Diffrient . | |
| 4,616,877 | 10/1986 | Slaats et al. . | |
| 4,668,012 | 5/1987 | Locher . | |
| 4,732,424 | 3/1988 | Uredat-Neuhoff . | |
| 5,100,200 | 3/1992 | Keusch et al. . | |
| 5,193,880 | 3/1993 | Keusch et al. . | |
| 5,308,144 | 5/1994 | Korn | 297/301 |

FOREIGN PATENT DOCUMENTS

| | | |
|---|---|---|
| 0176816 | 9/1985 | European Pat. Off. . |
| 2533428 | 3/1984 | France . |
| 3534496 | 11/1986 | Germany . |
| 3152945 | 6/1987 | Germany . |
| 8616836 | 12/1987 | Germany . |
| 8806835 | 10/1988 | Germany . |
| 8814409 | 3/1989 | Germany . |
| 3735256 | 4/1989 | Germany . |

*Primary Examiner*—Kenneth J. Dorner
*Assistant Examiner*—Cassandra Davis
*Attorney, Agent, or Firm*—Speckman, Pauley & Fejer

[57] ABSTRACT

A chair, in particular a work or office chair, having a seat that is pivotal toward the front of the seat about a horizontal pivot axis. The seat is variable in inclination and has a backrest that is overproportionately variable in inclination as a function of the change in inclination of the seat. With increasing inclination of the seat, the backrest follows an additional relative motion with respect to a backrest end of the seat. Pivot levers are positioned to support arms of the chair frame on both sides of the seat. The free ends of the pivot levers are fixedly and non-rotatably attached to the backrest for support. The seat is rotatably connected to the pivot levers approximately in its middle region. The desired relative motions between the seat, seat back and chair frame can be accomplished and varied solely by means of the connection between the seat, the backrest, pivot levers which serve as arm supports or armrests, and the chair frame. The seat, in the region of its front edge, is supported and shifted upward with respect to the pivot shaft of the pivot levers, and is non-adjustably or limitedly adjustably rotatable on extensions of the support arms. The axis of rotation between the pivot levers and the seat is limitedly adjustable or non-adjustable.

4 Claims, 4 Drawing Sheets

CHAIR

This is a continuation-in-part patent application of U.S. patent application Ser. No. 437,058, filed Nov. 14, 1989, now abandoned.

BACKGROUND OF THE INVENTION

1. Field of the Invention

This invention relates to a chair, in particular a work or office chair, having a seat that is pivotal toward the front about a horizontal pivot axis and is variable in inclination. A backrest is overproportionately variable in inclination, with respect to the change in inclination of the seat. With increasing inclination of the seat, the backrest follows an additional relative motion with respect to a backrest end of the seat. Pivot levers are positioned to support arms of the chair frame on both sides of the seat and free ends of the pivot levers are fixedly and non-rotatably attached to the backrest and support it. The seat is rotatably connected to the pivot levers, approximately in a middle region.

2. Description of the Prior Art

A chair of this type is known from German Utility Model 88 06 835. The relative motions between the backrest and the seat, which are necessary for the desired seating comfort, are attained with an adjusting device. The adjusting device has pivot levers and drive levers which perform the coupling between the backrest, seat and chair frame. Even if the pivot levers are used as armrests or arm supports, the drive levers with their additional linkages are always required on both support arms of the chair frame and on the seat.

SUMMARY OF THE INVENTION

It is one object of this invention to provide a chair of the type defined above in which the relative motions of the backrest, seat and chair frame which are necessary for the desired seating comfort can be attained and varied solely by the connection of such parts.

According to this invention, the above object and others are attained by the seat, in the region of its front edge, being supported and shifted upward with respect to the pivot shaft of the pivot levers. The seat is non-adjustably or limitedly rotatable when mounted on extensions of the support arms. The axis of rotation between the pivot levers and the seat is limitedly adjustable or non-adjustable.

By the selection of a stationary pivot shaft, or a pivot shaft adjustably mounted within oblong slots between the end portion of the seat and the extensions of the support arms of the chair frame, and by means of positioning the oblong slots, seat adjustments are obtained with or without lowering the front edge of the seat when the inclination of the seat is varied. The relative motion between the backrest and the seat can also be varied by the above factors, and an opposing motion between the backrest and the backrest end of the seat can be attained.

In one embodiment, the end portion in a transition zone of the seat is rotatably supported with bearing bolts mounted in oblong slots of the support arms. The bearing bolts can be tightened with nuts. The oblong slots are preferably located directly above the pivot shaft of the pivot levers on the support arms and the oblong slots rise toward the front of the seat. The pivot shaft, between the seat and the pivot levers, is located below the connecting line between the pivot shaft of the pivot levers on the support arms and the fixed fastening points of the pivot levers on the backrest. The bearing bolts, upon lowering of the seat, slide in the oblong slots from the front toward the back of the seat, and define the two terminal positions of the seat. Thus upon lowering the seat, the backrest is overproportionately varied in inclination, and is further adjusted in the direction toward the backrest end of the seat. Moreover, the front edge of the seat is lowered downward.

The terminal positions of the seat and the connected backrest are defined in such a way that in one terminal position, the pivot shaft between the seat and the pivot levers is located in a horizontal plane with the pivot shaft of the end portion of the seat on the support arms, which is located near the upper front ends of the oblong slots of the support arms. In another terminal position, the pivot shaft between the seat and the pivot levers is lowered to below the pivot shaft of the end portion of the seat on the support arms, which is located near the lower backrest ends of the oblong slots of the support arms.

In another embodiment of this invention, the front edge of the seat is not lowered when the seat inclination is varied. In such embodiment, the seat terminates in an end portion which is inclined toward the surface on which the chair stands. The end portion of the seat is non-adjustably and rotatably supported on the support arms. The pivot shaft between the seat and the pivot levers is located above the connecting line between the swivel shaft of the pivot levers on the support arms and the fixed fastening points of the pivot levers on the backrest. In a full pivoting range of the pivot levers, the pivot shaft between the seat and the pivot levers remains above the pivot shaft, of the end portion of the seat, on the support arms. When the seat is lowered, the pivot shaft between the seat and the pivot levers adjusts limitedly from the front to the back in oblong slots of the seat or of the pivot levers. Two terminal positions of the seat are defined. The pivot shaft of the end portion of the seat is limitedly adjustable in horizontal oblong slots of the support arms. Upon lowering the seat, the two terminal positions of the seat are defined, such that the pivot shaft between the seat and the pivot levers is located above the connecting line between the swivel shaft of the pivot levers on the support arms and the fixed fastening points of the pivot levers on the backrest. In the full pivoting range, the pivot levers remain above the pivot shaft of the end portion of the seat on the support arms. In another embodiment, the oblong slots in the support arms are positioned to begin above the swivel shaft of the pivot levers on the support arms and to extend toward the front.

A type of opposing motion between the seat and the backrest with simultaneous lowering of the front edge of the seat is accomplished, according to one embodiment, by having the pivot shaft of the end portion of the seat limitedly adjustable in oblong slots of the support arms. Upon lowering of the seat, two terminal positions of the seat are defined. The oblong slots of the support arms, with respect to the swivel shaft of the pivot levers on the support arms, are additionally offset toward the front and are upwardly inclined. In one terminal position, the pivot shaft between the seat and the pivot levers is located in a horizontal plane with the pivot shaft of the end portion of the seat on the support arms, which is located near the upper front ends of the oblong slots of the support arms. In another terminal position, the pivot shaft between the seat and the pivot levers is lowered to below the pivot shaft of the end portion of the seat on the support arms, which is located near the lower backrest ends of the oblong slots of the support arms.

Advantageously, in one embodiment of this invention, the pivot levers serve as armrests or arm supports or are connected therewith.

DESCRIPTION OF THE DRAWINGS

The invention is described in detail below in conjunction with preferred embodiments shown in schematic side views in the drawings wherein.

DESCRIPTION OF THE PREFERRED EMBODIMENTS

Figure 1:
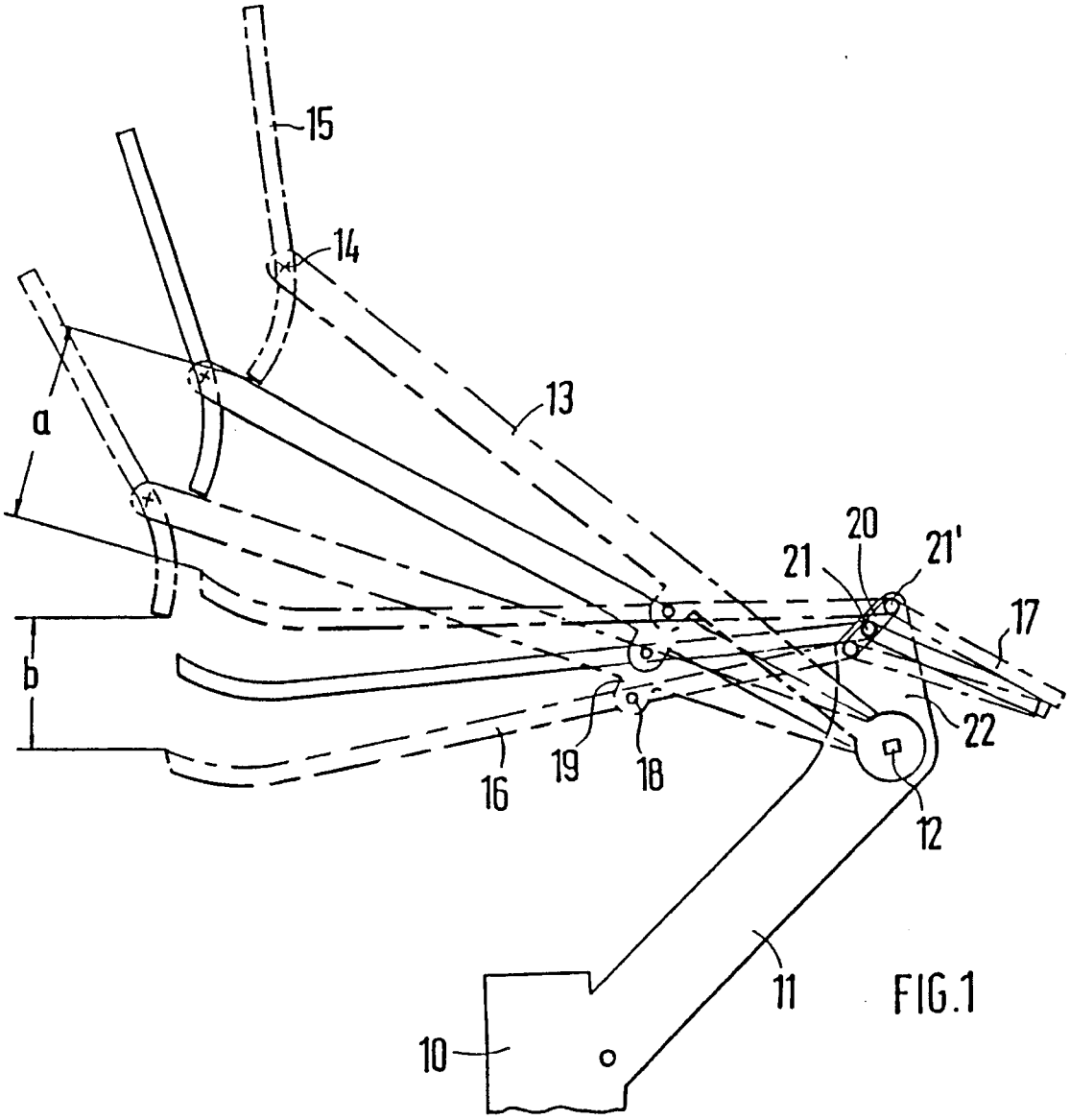
FIG. 1 shows a side view of one embodiment of a chair, in three different positions, wherein the phantom lines identify two of the three different positions, in which when the seat is lowered the backrest overproportionately varies its inclination and additionally moves in a direction toward the front end of the seat, during which the front seat edge is lowered, relative to the surface on which the chair stands.

In the embodiments of FIGS. 1–4, the only part of the chair frame that is shown is the upper end of column 10, from which support arms 11 begin. On support arms 11, which may also be combined into one support arm, two pivot levers 13, serving as armrests or arm supports, are rotatably supported by swivel shaft 12. This can be structurally accomplished in various ways which are apparent to those skilled in the art. The other ends of pivot levers 13 are non-rotatably attached on both sides of backrest 15 at fixed fastening points 14. When the inclination of pivot levers 13 is varied, the inclination of backrest 15, with respect to the vertical as shown in FIGS. 1–4, is also varied.

Figure 4:
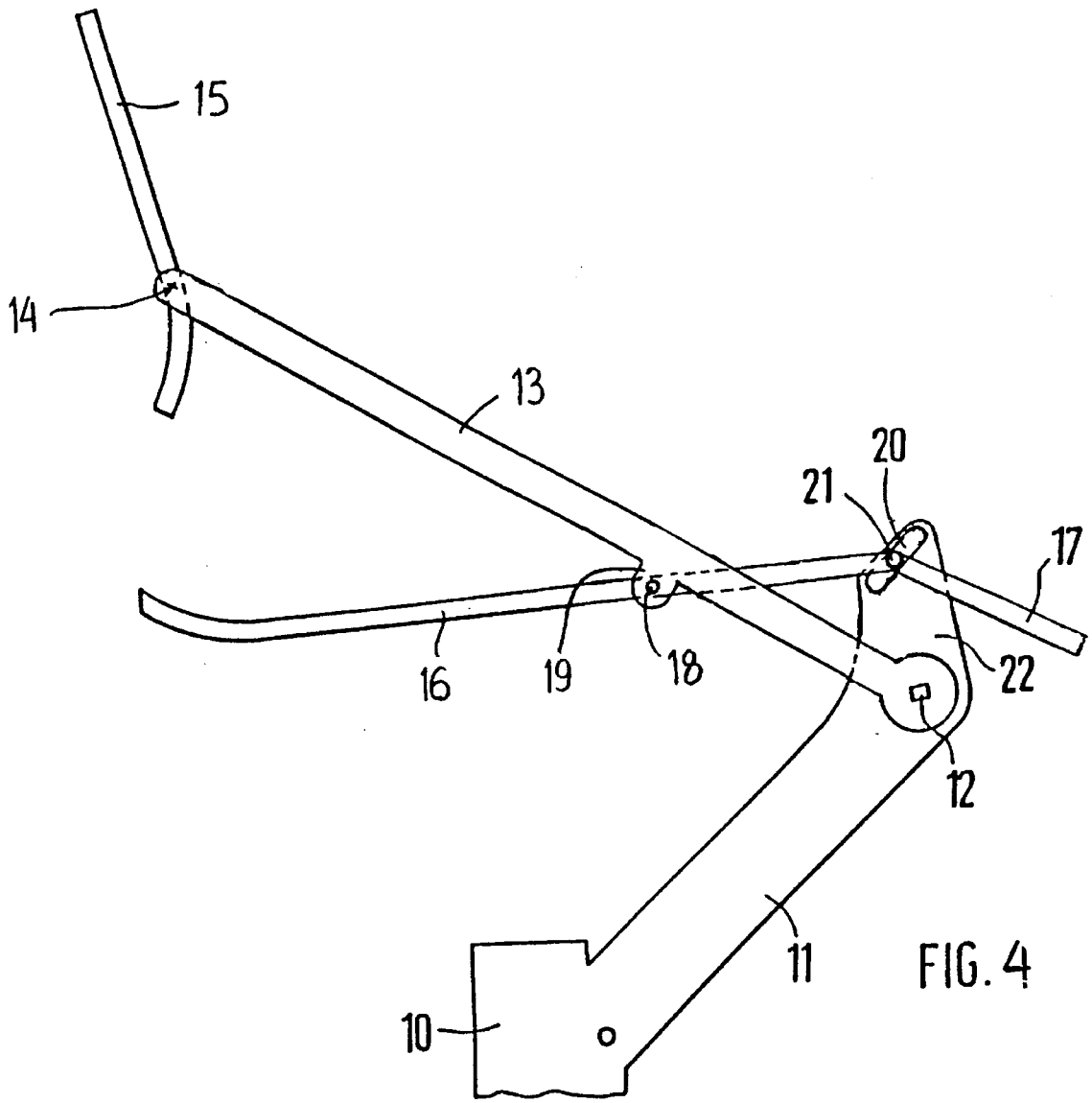
FIG. 4 shows a side view of the chair shown in FIG. 1, but without the phantom lines for purposes of clarity.

In the embodiment shown in FIGS. 1 and 4, seat 16, in its front or forward region, terminates in end portion 17. End portion 17 is inclined with respect to the floor surface on which the chair stands. Pivot levers 13 are pivotally connected to seat 16, such as with pivot shaft 18, which is located below the connecting line between swivel shaft 12 of pivot levers 13 and support arms 11 and fixed fastening points 14 of pivot levers 13 on backrest 15. Pivot shafts 18 also connect to bearing brackets 19 of pivot levers 13. Pivot shaft 21' is used to rotatably support seat 16 on support arms 11. In one embodiment of this invention, pivot shafts 21' may comprise bearing bolts that are guided and limitedly adjustable in oblong slots 20 of support arms 11. Such bearing bolts provide means for manually adjusting and maintaining seat 16 in a fixed position with respect to support arms 11. For example, each pivot shaft 21 can be constructed as a threaded bolt and a nut or wing nut can be tightened on the bolt to fix seat 16 and thus the chair in a desired position. Oblong slots 20 are incorporated in extensions 22 of support arms 11 and are preferably located vertically above swivel shaft 12 of pivot levers 13. Oblong slots 20 are inclined or rise toward the front of support arms 11. In FIG. 1, the two terminal positions of seat 16 and one intermediate position are shown. It can be seen that upon a change in inclination of seat 16 when it is lowered, the inclination of backrest 15 overproportionately changes with respect to the vertical. The angle of inclination of backrest 15, with respect to the vertical, increases to a greater extent than the variation in the angle of inclination of seat 16. Pivot shaft 21', of seat 16 on support arms 11, follows a downward motion in inclined oblong slots 20 in the positioning process. Upon lowering seat 16, the spacing between fixed fastening points 14 of pivot levers 13 on backrest 15 and the associated end of seat 16 decreases, as shown by distances a and b. The front seat edge, which is defined by the transition between seat 16 and end portion 17, is lowered toward the floor upon lowering of or increasing the inclination of seat 16. As shown in FIG. 1, the resultant displacement of the front seat edge in the direction toward backrest 15 is negligible. Pivot shaft 21' is located at the transition between seat 16 and end portion 17. The length and inclination of oblong slots 20 determine the lowering motion of the front seat edge and the two terminal positions of seat 16 are defined by bearing bolt 21 stopping at both ends of oblong slot 20.

Figure 2:
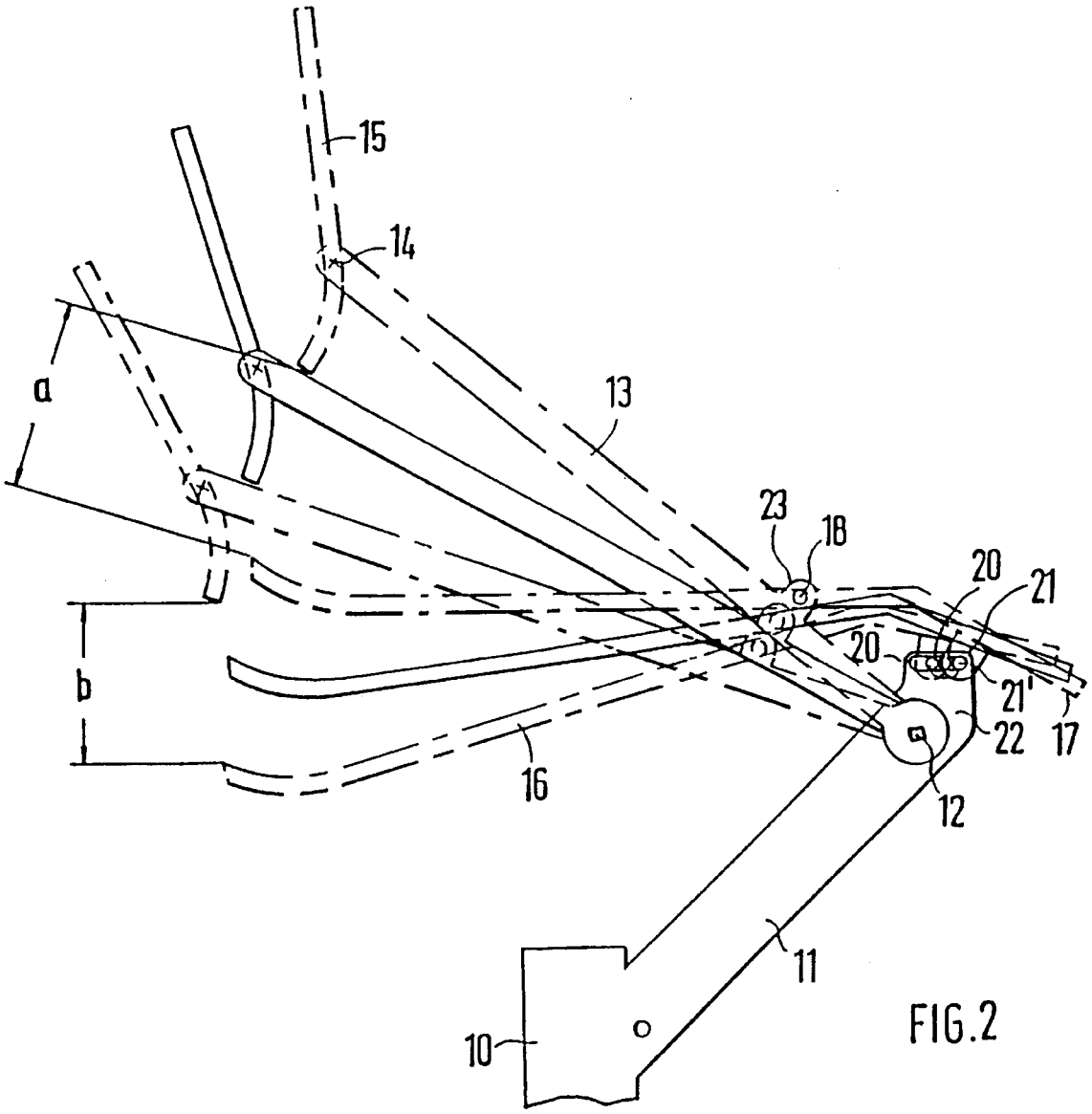
FIG. 2 shows a side view of another embodiment of the chair, in three different positions, wherein the phantom lines identify two of the three different positions, in which upon lowering of the seat the backrest follows the same motions, but the seat follows a greater motion component in the horizontal direction, relative to the backrest, so that the front seat edge practically maintains its height, relative to the surface on which the chair stands.

In the embodiment shown in FIG. 2, oblong slots 20 in support arms 11 are located above pivot shaft 12 of pivot levers 13 on support arms 11. As shown in FIG. 2, oblong slots 20 begin above pivot shaft 12 and extend horizontally toward the front. In such embodiment, pivot shaft 18 between pivot levers 13 and seat 16 is located above the connecting line between swivel shaft 12 of pivot levers 13 on support arms 11 and fixed fastening points 14 of pivot levers 13 on backrest 15. Pivot shaft 18 also connects to bearing bracket 23 of pivot lever 13. A spacing of approximately 30 mm has proven to be advantageous. In lowering seat 16, bearing bolts 21 follow a horizontal motion in oblong slots 20, so that pivot shaft 21' shifts in a limited extent in the direction toward backrest 15. The additional relative motion between backrest 15 and the facing end of seat 16 is maintained, as shown by distances a and b between the end of seat 16 and fixed fastening points 14 of pivot levers 13 on backrest 15. However, the front seat edge, in the transition region between seat 16 and end portion 17, practically remain at the same height, relative to the floor.

In such embodiment pivot shaft 21' can also be located at fixed points of support arms 11, if pivot shaft 18 is made limitedly adjustable. This can most simply be accomplished by means of oblong slots in seat 16 or pivot levers 13, which allow limited horizontal adjustment between seat 16 and pivot levers 13.

Figure 3:
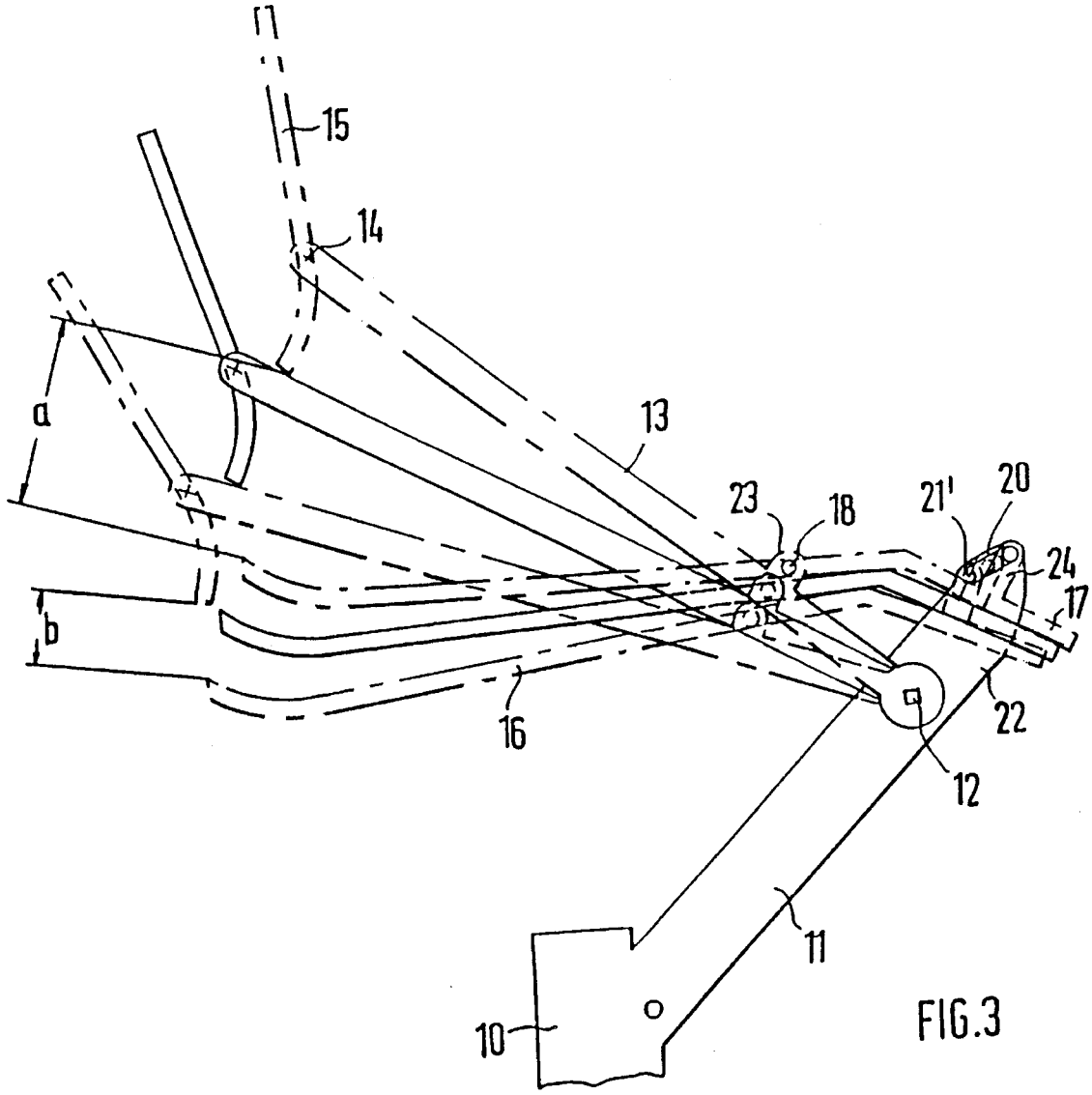
FIG. 3 shows yet another embodiment of the chair, in three different positions, wherein the phantom lines identify two of the three different positions, in which, upon lowering the seat, the upper backrest edge of the seat follows an opposing motion to the lowering motion of the backrest, and the front edge of the seat is lowered along with it.

In the embodiment shown in FIG. 3, not only is pivot shaft 18 between pivot levers 13 and seat 16 located above the connecting line between swivel shaft 12 of pivot levers 13 on support arms 11 and fixed fastening points 14 of pivot levers 13 on backrest 15, but there is also a different location for pivot shaft 21' of seat 16 on the chair frame. Pivot shaft 21' is located above end portion 17, as shown by bearing brackets 24. Oblong slots 20 are also shifted toward the front, relative to swivel shaft 12 of pivot levers 13 on support arms 11, and are designed such that they ascend toward the front. In one terminal position, pivot shaft 21' is located in the region of the ends oriented toward the front of oblong slots 20 and upon the lowering of seat 16, pivot shaft 21' adjusts into the region of the ends oriented toward the rear of oblong slots 20. Thus, upon lowering seat 16, the front edge of the seat is also lowered. With the adjustment of seat 16 simultaneously occurring in the direction of backrest 15, in combination with the shift of pivot shaft 18 between seat 16 and pivot levers 13 to above the connecting line between swivel shaft 12 and fixed fastening points 14, there is a type of opposing motion of the end of seat 16 oriented toward backrest 15. Thus the same pivot angle of pivot levers 13 is attained at a lesser variation of the angle of inclination of seat 16, as can readily be seen by superimposing FIG. 3 on FIG. 1 or FIG. 2. In this preferred embodiment, the distance between the backrest end, the end oriented toward backrest 15 of seat 16, and fixed fastening points 14 of pivot levers 13 on backrest 15 is also varied to an increased extent, as indicated by distance b.

In the upper terminal position of seat 16, pivot shaft 21' and pivot shaft 18 are located approximately in the same horizontal plane, while in the lower terminal position of seat 16 pivot shaft 18 is pivoted to below the horizontal plane in which pivot shaft 21' is located. Oblong slots 20 determine these terminal positions and by their dimensions and degree of inclination that they define for the lowering path for the front edge of the seat.

Pivot levers 13 are advantageously designed as armrests or arm supports, or are provided with such. The preferred embodiments of this invention show how to achieve all of the adjusting means required for the desired relative motions between the seat, backrest and chair frame, solely with these elements and without requiring drive levers and linkages for such drive levers. The sole critical factor is the positioning of oblong slots 20 in support arms 11 or seat 16, or pivot levers 13, and their dimensions and alignment and the position of pivot shaft 18 between seat 16 and pivot levers 13, with respect to the connecting line between swivel shaft 12 of pivot levers 13 on support arms 11 and fixed fastening points 14 of pivot levers 13 on backrest 15.

I claim:

1. A chair comprising: a seat (16) with a variable inclination; a backrest (15) having an automatically variable overproportionally inclination dependent upon an alteration in said variable inclination of said seat (16), whereby as said variable inclination of said seat (16) increases, said backrest (15) executes an additional relative movement with respect to a back edge of said seat (16); on each of both sides of said seat (16), a pivot lever (13) disposed on a support arm (11) of a chair frame, said support arm (11) oriented towards a front of said chair; an upper end of said pivot lever (13) non-rotatably connected to said backrest (15) and supporting said backrest (15); a seat pivot shaft (21, 21') of said seat (16) mounted in a displaceable and rotatable manner in a region of a front edge of said seat (16) within an oblong slot (20) formed at an end of said support arm (11) distal from said chair frame, said pivot lever (13) pivotably connected to said seat (16); a lower end of said pivot lever (13) comprising an arm pivot shaft (12) rotatably connected to said end of said support arm (11) distal from said chair frame, said arm pivot shaft (12) connected to said support arm (11) of said chair frame and disposed lower than said seat pivot shaft (21, 21') of said seat (16); said pivot lever (13) comprising an armrest; said arm pivot shaft (12) of said lower end of said pivot lever (13) disposed substantially beneath said seat pivot shaft (21, 21') of said seat (16); and said oblong slot (20) inclined upwards toward said front edge of said seat (16).

2. A chair according to claim 1, wherein said oblong slot (20) is disposed approximately vertically above said arm pivot shaft (12) of said pivot lever (13) .

3. A chair according to claim 1, wherein said oblong slot (20) is offset relative to said arm pivot shaft (12) of said pivot lever (13), in a direction toward said front edge of said seat (16).

4. A chair according to claim 3, wherein said seat (16) comprises a transition in a front area into an end portion (17) which inclines downward toward a floor surface, and said oblong slots (20) are disposed in a region of said end portion (17).

* * * * *